US005155540A

United States Patent [19]

Yamada et al.

[11] Patent Number: 5,155,540

[45] Date of Patent: Oct. 13, 1992

[54] AUTOMATIC DUPLEX RECORDING APPARATUS HAVING DETECTORS FOR CONTROLLING FEEDING AND REFEEDING OF A RECORDING SHEET

[75] Inventors: Yasushi Yamada; Tsuyoshi Mizubata; Akihiko Nishiki, all of Hachioji, Japan

[73] Assignee: Konica Corporation, Tokyo, Japan

[21] Appl. No.: 699,469

[22] Filed: May 13, 1991

[30] Foreign Application Priority Data

May 18, 1990 [JP] Japan ..... 2-129775
Jul. 25, 1990 [JP] Japan ..... 2-196654

[51] Int. Cl.[5] ..... G03G 21/00

[52] U.S. Cl. ..... 355/319; 271/3.1; 355/321

[58] Field of Search ..... 355/308, 309, 316, 318, 355/319, 321, 206, 208, 204; 271/3, 3.1, 65

[56] References Cited

U.S. PATENT DOCUMENTS 4,437,756 3/1984 Kawakubo et al. ..... 355/319
4,745,439 5/1988 Hanada et al. ..... 355/319 X
4,853,740 8/1989 Ushio et al. ..... 355/319

FOREIGN PATENT DOCUMENTS 0221328 5/1987 European Pat. Off. .
59-82247 5/1984 Japan .
59-114227 7/1984 Japan .
60-2241 1/1985 Japan .
62-161641 7/1987 Japan .

OTHER PUBLICATIONS

European Search Report.

*Primary Examiner*—A. T. Grimley
*Assistant Examiner*—William J. Royer
*Attorney, Agent, or Firm*—Frishauf, Holtz, Goodman & Woodward

[57] ABSTRACT

In an automatic two-sided copying apparatus, a recording sheet which has a toner image on its one side is reversed by an automatic duplex unit and the recording sheet is fed from the automatic duplex unit to be copied on its second side. The apparatus is provided with a feeding state detector which detects number of recording sheets set by an operator to be copied, have been conveyed from the sheet feeding section in the main body. A refeeding state detector which detects that refeeding of at least one of the stacked recording sheets in the automatic duplex unit is possible. A timing controller which receives detection outputs from both the feeding state detector and the refeeding state detector initiates the start of refeeding from the automatic duplex unit.

4 Claims, 15 Drawing Sheets

AUTOMATIC DUPLEX RECORDING APPARATUS HAVING DETECTORS FOR CONTROLLING FEEDING AND REFEEDING OF A RECORDING SHEET

BACKGROUND OF THE INVENTION

The present invention relates to an improvement in copy-productivity of an automatic duplex copying apparatus which reads both sides of a document and produces copies on both sides of a recording sheet.

As a device for reversing a document and thereby copying from both sides of the document, there has been known a reversible automatic document feeder (hereinafter referred to as RADF). When such a device is used, a large number of copies can easily be produced. Further, copies produced are in the same sequence as that of the documents, which eliminates the necessity of changing the sequence of produced copies.

Further, when interlocked with a sorter, collating and sorting by page can automatically be made and a large number of copies can be put in order accurately.

As a device wherein copies are produced automatically on both sides of a recording sheet through a single operation of a button, there has been known an ADF. When this unit is used, information on both sides of a document are copied onto both sides of a recording sheet, resulting in a saving of cost for recording sheets and easy filing. Further, it can be applied in many ways, including collecting materials in a booklet form for quick view.

When two-sided copying is made on a conventional automatic duplex copying apparatus, sheet refeeding from ADU (Automatic Duplex Unit) is started only after the detection of the stacked last recording sheet (having a copy only on one side) among the number of sheets set for 1st side copying.

The above-mentioned operations will, be explained as follows, referring to the line chart of FIG. 6. When a copy button is pressed (FIG. 6 (*a*)), sheet feeding for 1st side copying is made (FIG. 6 (*b*)). As an assumption for the explanation of the operations, a certain number of copies are set (hereinafter the number of copies set is called a set number of copying). When the first sheet of the recording sheets arrives at a photosensitive body, 1st side copying is started and the 1st side copying is continued until the set number of copying is completed. (FIG. 6 (*c*)). The recording sheets which have been finished in terms of 1st side copying are stacked in ADU (FIG. 6 (*d*)). After completion of stacking in the ADU, sheet aligning is made in ADU (FIG. 6 (*e*)). After completion of the sheet aligning, sheet refeeding from ADU is made (FIG. 6 (*f*)) and then 2nd side copying is made (FIG. 6 (*g*)).

According to the time chart for the foregoing, there is a period of time for the photosensitive body to wait (non-operation time) between the completion of 1st side copying and the start of 2nd side copying. Due to this standby period for a photoreceptor, it has been difficult to improve the copy-productivity for duplex copying.

Incidentally, though the ratio of the standby period to the copying time depends upon the set number of copying, it has been impeding the improvement of copy-productivity.

The present invention relates to a sheet feeding device for a sheet-shaped paper used for an image recording apparatus such as an electrophotographic copying machine and for a printing apparatus, and in particular, to the improvement of a sheet feeding device wherein a sheet-shaped paper ejected from the processing section is fed successively onto the top of a stack of paper loaded on a sheet tray while the bottom sheet of the aforesaid stacked paper is fed to the processing section, for example, a recording sheet recirculating feeder capable of having an automatic two-sided recording mode wherein images are recorded on both sides of a recording sheet, or an automatic multiple recording mode wherein multiple images are recorded on one side of a recording sheet, or the improvement of a sheet feeding device such as an automatic recirculating document handler wherein documents to be copied are fed in a circulating manner from the processing section to the document tray.

Generally, in an image recording apparatus such as an electrophotographic copying machine or in a printing apparatus, technologies for an automatic duplex copying apparatus capable of recording not only on one side but also on both sides of a recording sheet have been suggested. In conventional automatic duplex copying apparatus, a recording sheet, after being copied on one side, is held midway for a while, and fed again to the image-forming section. These technologies are disclosed in Japanese Patent Publication Open to Public Inspection Nos. 82247/1984, 114227/1984, 2241/1985 and 161641/1987 (hereinafter referred to as Japanese Patent O.P.I. Publication).

In such an automatic duplex copying apparatus, a recording sheet (a copy paper) copied on one side at an image-transfer section is turned and fed below the image-transfer section to be loaded on a stacker unit, and then the recording sheet is fed out and conveyed upward again and turned to be fed to the image-transfer section for copying on the other side of the recording sheet.

In a recording sheet feeder such as the aforesaid automatic two sided recording device, recording sheets fed successively to an intermediate tray need to be aligned accurately before they are conveyed to the image-forming section. When recording sheets are fed again to the image-forming section without being aligned accurately, conveyance trouble may take place, or when multiple recording is made on the obverse side of the recording sheet, registration error takes place between the first copied image and the second copied image and when recording on both sides of the recording sheet, registration error takes place between the copied image on the obverse side and that on the reverse side of the recording sheet.

In order to prevent the aforesaid registration error on the recording sheet, it is necessary to regulate both sides of each of the recording sheets conveyed and stacked on an intermediate tray and thereby prevent registration error for refeeding of sheets after an accurate sheet alignment.

When sheet width regulating members at both sides of an intermediate tray for regulating both sides of the recording sheet are provided at predetermined positions respectively for each recording sheet width, a recording sheet entering the intermediate tray, due to its direction being non-constant, hits the sheet width regulating member causing conveyance trouble, warping of the sheet and sheet irregularity including sheet skew. When the guide distance of the sheet width regulating member is broadened for preventing aforesaid troubles, sheet alignment fails to be stable.

In order to overcome these problems, it is desirable that one or both of sheet width regulating members are made to be movable and when the recording sheet enters an intermediate tray, the sheet width regulating members open up to make a slightly broader distance, and when recording sheets are stacked on the intermediate tray, sheet width regulating members move inward to slightly press both sides of the recording sheets for sheet alignment.

In prior art copying device as stated, a stack of recording sheets on a sheet tray (stacker) of the aforesaid ADU are subjected to sheet alignment after all recording sheets, each having been copied on its first side have been ejected from the main body of the copying device into an automatic duplex unit (ADU), and then sheet feeding is started after the completion of preparation for sheet feeding out and then the sheet is conveyed to aforesaid image-transfer section for forming a copied image on the second side of the recording sheet. Therefore, a certain period of time for preparation of switching has been needed between the completion of copying on the first side of the recording sheet and the start of copying on the second side thereof, resulting in the drop of copy-productivity.

Therefore, it is desirable to improve copy-productivity in the manner wherein the recording sheets are conveyed so that the recording sheets, each having been copied on its first side and stacked on the ADU may pass through the image-transfer section for the start of copying on the second side while the recording sheets, each having been copied on its first side, are being fed to the ADU from the image-transfer section.

However, the distance between the recording sheets adjoining each other for refeeding is changed by adjusting and controlling so that both sheet alignment and sheet refeeding may be conducted separately, because sheet refeeding and sheet alignment can not be made concurrently as disclosed in Japanese Patent O.P.I. Publication No. 161641/1987. Thus, in the prior art the change of distance between recording sheets adjoining each other has required a period of time and thereby the copy-productivity has been low.

SUMMARY OF THE INVENTION

An object of the automatic duplex copying apparatus of the invention is to realize an automatic duplex copying apparatus wherein it is possible to improve copy-productivity for two-sided copying by shortening a period of time needed between the completion of copying on the first side of the recording sheet and the start of copying on the second side thereof.

A further object of the invention is to provide a sheet alignment device wherein the control of operations for feeding out a recording sheet positioned at the bottom of a stack of recording sheets while stacking a recording sheet on the top of the stack of recording sheets is simplified in a sheet feeding device and standby time is eliminated, thereby copy-productivity can be improved.

An automatic duplex copying apparatus of the present invention wherein the recording sheet which has been copied on one side is reversed by an automatic duplex unit and the recording sheet fed out from the automatic duplex unit is to be copied on its second side is provided with;

a feeding state detection means which detects that the recording sheets in the number of copies set have been conveyed from the sheet feeding section in the main body, a refeeding state detection means which detects that refeeding of at least one of the stacked recording sheets in the automatic duplex unit is possible, and a timing control means which receives detection output from both a feeding state detection means and a refeeding state detection means and gives instructions for the start of refeeding to the automatic duplex unit.

In an automatic duplex copying apparatus of the invention, the detection output by means of the feeding state detection means is generated when it is detected that the recording sheets in the number of copies set have been conveyed from the sheet feeding section in a main body, and the detection output by means of the refeeding state detection means is generated when refeeding of at least one of the recording sheets stacked on the automatic duplex unit is possible. The timing control means, after receiving both detection output, gives instructions for the start of refeeding to the automatic duplex unit.

In this case, since the detection output is generated before all of the recording sheets in the number of copies set have been stacked on the automatic duplex unit, generation of standby time between copying on the first side of the recording sheet and copying on the second side thereof can be limited to the minimum.

In a sheet feeding device of the invention wherein a sheet-shaped recording sheet ejected from a processing section is stacked successively on the top of a stack of recording sheets stacked on a sheet tray while the lowermost recording sheet of the stack of recording sheets is fed out for refeeding to the processing section, there are provided a sheet width aligning means which is driven by a driving means to move in the direction of the width of the sheet that is perpendicular to the feeding direction of sheets in various sizes stacked on aforesaid sheet tray and thus regulates the width of sheets by touching them, and a feeding out means that feeds out the lowermost sheet of the stack of sheets stacked on the aforesaid sheet tray, and at least a part of sheet alignment action performed by the aforesaid sheet width aligning, means and a part of sheet feeding out action conducted by the aforesaid feeding out means can be carried out simultaneously.

The sheet aligning means in a sheet feeding device of the invention is provided with the first sheet width regulating means which is driven to move in the direction of the width of the sheet that is perpendicular to the feeding direction of sheets in various sizes stacked on the aforesaid sheet tray and thus regulates the width of sheets by touching them in a sheet feeding device wherein a sheet-shaped recording sheet ejected from a processing section is stacked successively on the top of a stack of recording sheets stacked on a sheet tray while the lowermost recording sheet of the stack of recording sheets is fed out for refeeding to the processing section and with the second sheet width regulating means, which has its sheet width regulating surface above the aforesaid first sheet width regulating means and is capable of moving in the width direction of a sheet ejected from the processing section and fed onto the top of a stack of sheets and thus regulates the sheet width by touching the sides of the fed sheets.

Further, in the sheet width aligning means of the invention, the aforesaid second sheet width regulating means has its movement range wherein it can move independently from the movement of the aforesaid first sheet width regulating means.

Furthermore, in the sheet width aligning means of the invention, a sensor that detects the passage of a sheet is provided upstream in the direction of sheet feeding of the aforesaid sheet tray, and the detection of the passage of the trailing edge of a sheet made by the aforesaid sensor controls the aforesaid second sheet width regulating means to move.

Moreover, in the sheet width aligning means of the invention, the distance between guide surfaces of the aforesaid second sheet width regulating means is set to be wider than the width of a sheet before the sheet is fed onto the aforesaid sheet tray, and after the trailing edge of the sheet is detected by aforesaid sensor, the aforesaid second sheet width regulating member is driven controllably so that the aforesaid distance between guide surfaces may be narrowed to be almost equal to the sheet width.

The sheet aligning means in a sheet feeding device of the invention is provided with at least one first sheet width regulating means which is driven to slide back and forth by a driving means to move in the direction of the width of the sheet that is perpendicular to the feeding direction of the sheets in various sizes stacked on the aforesaid sheet tray and thus regulates the width of sheets by touching them in a sheet feeding device wherein a sheet-shaped recording sheet ejected from a processing section is stacked successively on the top of a stack of recording sheets stacked on a sheet tray, while the lowermost recording sheet of the stack of recording sheets is fed out for refeeding to the processing section, and with the second sheet width regulating means which has its sheet width regulating surface above the aforesaid first sheet width regulating means and is capable of moving in the width direction of a sheet ejected from the processing section and fed onto the top of a stack of sheets and further is capable of the moving with a time lag against the movement of aforesaid first sheet width regulating member by means of the aforesaid driving means and thus regulates the sheet width by touching the side of the fed sheets.

In the sheet width aligning means of the invention, the aforesaid second sheet width regulating means is mounted indirectly on the aforesaid first sheet width regulating means through an intermediate moving body so that the second sheet width regulating means can move with a time lag.

Further, in the sheet width aligning means of the invention, the aforesaid intermediate moving body is provided in a recess with a predetermined space on the driving means for the aforesaid first sheet regulating means.

DESCRIPTION OF THE PREFERRED EMBODIMENT

Figure 1:
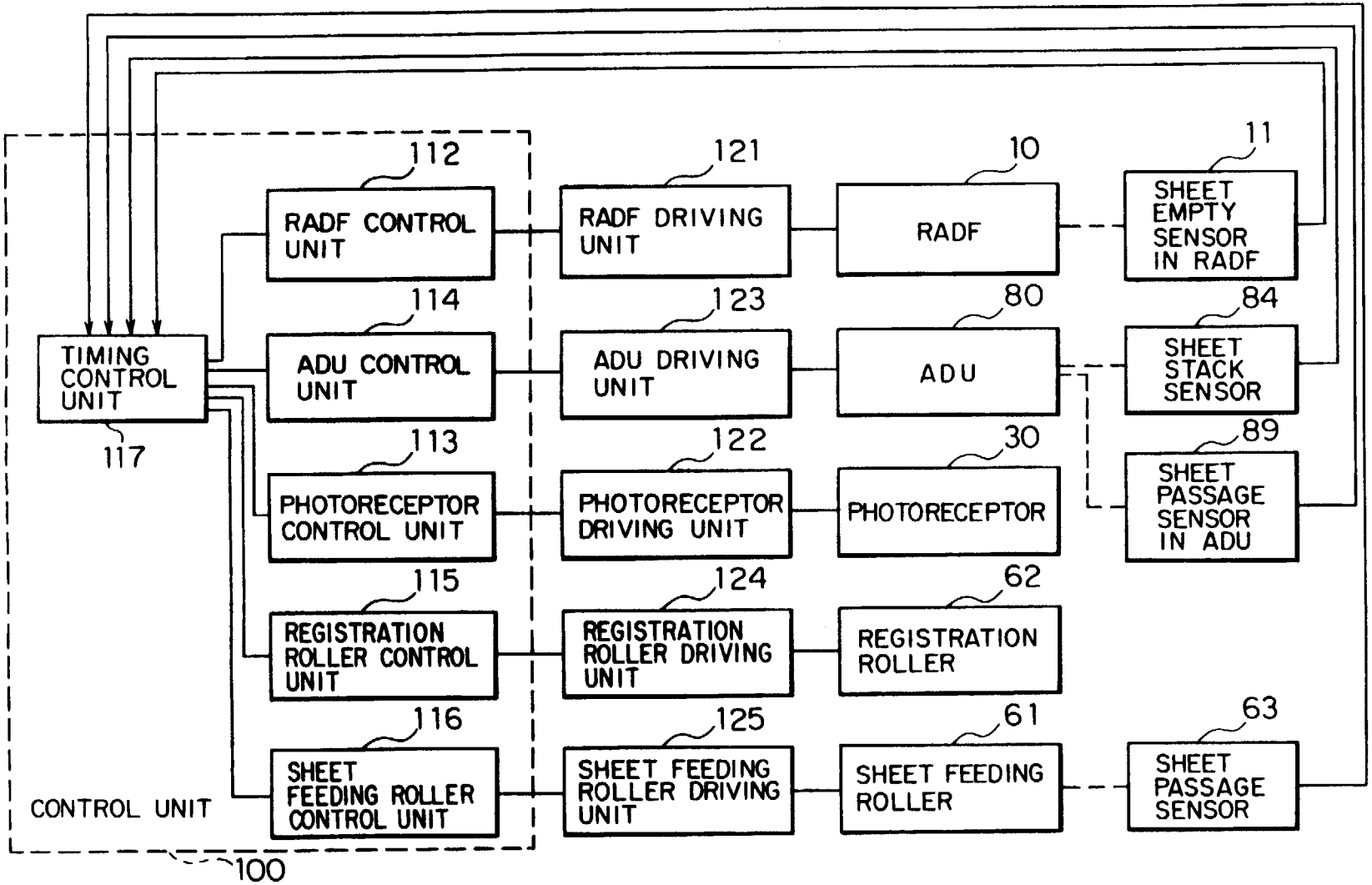
FIG. 1 represents a block diagram showing the electric constitution of an automatic duplex copying apparatus that is an example of the invention.

Examples of the invention will be explained in detail as follows, referring to the drawings.

First, the outline of the operations in an electrophotographic copying apparatus to which the invention is applied will be explained, referring to FIG. 2.

Figure 2:
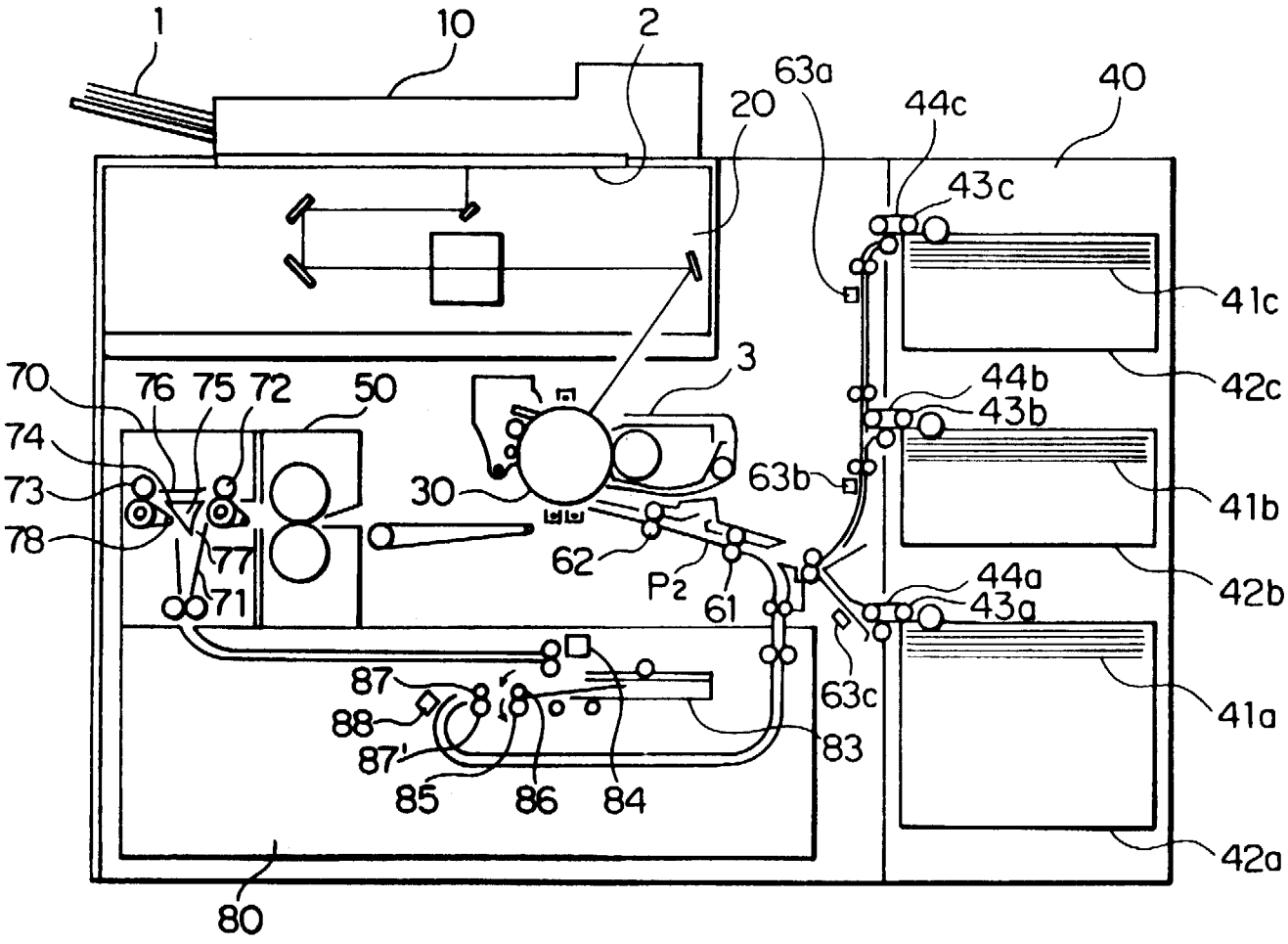
FIG. 2 is a structural diagram illustrating the state of operations in the apparatus of the example.

In FIG. 2, document 1 placed on reversible automatic document feeder (hereinafter referred to as RADF) 10 is moved onto platen glass 2 by RADF 10 at the start of copying. As shown in FIG. 1, RADF control unit 112 outputs a signal to RADF driving unit 121 to drive RADF 10. Document 1 placed on platen glass 2 is exposed to light by means of scanning exposure optics unit 20, and thereby a latent image corresponding to document 1 is formed on photoreceptor 30. As shown in FIG. 1, photoreceptor control unit 113 outputs a signal to photoreceptor driving unit 122 to rotate photoreceptor 30. This latent image is converted to a toner image on the surface of photoreceptor 30 by photoreceptor image forming section 3. The toner image is transferred onto one of the recording sheets 41*a*, 41*b* and 41*c* which is fed from sheet feeding unit 40 which will be described later, and the transferred toner image is heated and fixed by fixing unit 50. The recording sheet thus copied on its first side is led to automatic duplex unit (hereinafter referred to as ADU) 80 by sheet ejection switching section 70. Then, the second side of the recording sheet reversed by ADU 80 and conveyed to photoreceptor 30 again, is subjected to copying (formation of toner image). After the toner image is fixed, the recording sheet is ejected to the outside of the apparatus by means of sheet ejection switching section 70.

Next, referring to FIG. 1 showing the electrical structure of the apparatus in the present example, the aforesaid FIG. 2 and FIGS. 3–5 showing the flow of operations in the apparatus in the present example, the sequence of operations along the flow of sheet feeding in the present example will be explained successively. Control unit 100 in FIG. 1 includes the control elements 111, 112, 113, 114, 115 and 116; control unit 100 controls the entire apparatus including elements other than the elements indicated above.

First, setting of mode such as the number of copies, recording sheet size, magnification and final ejection position are made on the operation setting section (not shown) (step (1)).

After documents are set on RADF 10 and a copy button is pressed, copying is started.

As stated above, at least one recording sheets 41*a*, 41*b* and 41*c* are fed to the photoreceptor 30 from sheet feeding unit 40 (step (3)). On the sheet feeding unit 40, there are provided three sheet cassettes 42*a*–42*c* capable of holding three types of recording sheets 41*a*–41*c* in different sizes, for example. Recording sheets 41*a*–41*c* are fed out from sheet cassettes 42*a*–42*c* by feed-out rollers 43*a*–43*c* and feed-out belts 44*a*–44*c*. Feed-out belts 44*a*–44*c* are spread over feed-out rollers 43*a*–43*c* respectively, and when feed-out rollers 43*a*–43*c* rotate clockwise (FIG. 2) under the condition that recording sheets 41*a*–41*c* are in contact with feed-out belts 44*a*–44*c* respectively, the recording sheets 41*a*–41*c* each positioned on the top is fed out leftward in FIG. 2 sheet by sheet.

Recording sheets 41*a*–41*c* fed out by feed-out belts 44*a*–44*c* are conveyed to the position P2 (FIG. 2) by means of sheet feeding roller 61 and registration roller 62. As shown in FIG. 1, sheet feeding roller control unit 116 outputs a signal to sheet feeding roller driving unit 125 to drive sheet feeding roller 61. From the position P2, the recording sheet is fed out by registration roller 62 after being synchronized with photoreceptor 30, and then a toner image is transferred onto the recording sheet from the surface of photoreceptor 30 (copying on the first side: step (4)). As shown in FIG. 1, registration roller control unit 115 outputs a signal to registration driving unit 124 to rotate registration roller 62.

After the aforesaid step, in the case of one-side copying, the recording sheet is subjected to heating and fixing in fixing unit 50 and then ejected to the outside of the apparatus from sheet ejection switching section 70, thus, copying is completed.

In the case of duplex copying, refeeding (step (7)) of recording sheets stacked in ADU 80 is carried out as stated below.

Downstream of the fixing unit 50, there is provided sheet ejection switching section 70 which has a function for switching to sheet ejection path 76 that leads recording sheet 41 after fixing straight to the outside of the apparatus or to introduction path 77 for guiding the recording sheet to guide plate 71 for duplex copying. The sheet ejection switching means 70 is composed of guide plate 71, upstream roller 72, downstream roller 73, movable separating body 75 which is of an inverse triangle shape in its section and swivels with shaft 74 as a fulcrum, and an electromagnetic solenoid (not shown). Due to the movable separating body 75 whose section is an inverse triangle, sheet ejection path 76, introduction path 77 connected to guide plate 71 along the right side, and reversing sheet ejection path 78 which connects guide plate 71 to downstream roller 73 along the left side are formed.

The movable separating body 75, being driven by a driving unit such as an electromagnetic solenoid (not shown), moves its right tip up and down and switches by opening introduction path 77 and closing sheet ejection path 76 or by closing introduction path 77 and opening sheet ejection path 76.

The recording sheets 41*a*, 41*b* and 41*c* are fed down to the lower portion (FIG. 2) through sheet ejection switching section 70 and are then fed into ADU 80 (loading in ADU; step (5)).

The recording sheets 41*a*, 41*b* and 41*c* conveyed to automatic duplex unit 80 is reversed against stacker 83 and ejected. In this case, the trailing edge of the recording sheet is detected by stack sensor 84 composed of a photosensor or the like. Incidentally, the stack sensor 84 forms a refeeding state detection means.

Ejected recording sheets 41*a*, 41*b* and 41*c* slides on the surface of stacker 83 and stops when it hits a stopper plane. Successive recording sheets 41*a*, 41*b* and 41*c* are fed in succession and are stacked on stacker 83 one after another and hit the stopper plane, thus the leading edges of recording sheets 41 are aligned.

As shown in FIG. 1, this is accomplished by the ADU control unit 114 outputting the signals to ADU driving unit 123 for the start of refeeding of the recording sheets by rotating roller 85 and multi-feed prevention roller 86 counterclockwise. Thereby, a plurality of recording sheets 41*a*, 41*b* and 41*c* are stacked on stacker 83 are fed out successively sheet by sheet beginning with the lowermost sheet.

The recording sheets 41*a*, 41*b* and 41*c* are further conveyed by sheet feeding roller 87 and sheet feeding roller 87' both of which are in pressure-contact with each other and rotate, and passage of the leading edge of recording sheets 41*a*, 41*b* and 41*c* are detected by ADU passage sensor 88 composed of a photosensor. The recording sheet 41*a*, 41*b* and 41*c* are further conveyed and fed into registration roller 62 (step (7)).

After that, the recording sheet is subjected to copying on its second side (reverse side) at photoreceptor 30 (step (8)), and after being processed for fixing by fixing unit 50, passes through reversing sheet ejection processing section 76 of sheet ejection switching section 70 and then is ejected to the outside of the apparatus.

In the manner mentioned above, the first of 41*a*, 41*b* and 41*c* recording sheet is re-fed, and is copied on its reverse side. After that, the signals for the start of refeeding are inputted and thereby refeeding for the next recording sheets 41*a*, 41*b* and 41*c* that is on standby on stacker 83 is started. After that, the aforesaid refeeding actions and reverse side copying action are repeated for the number of N which is the number of copies set.

Incidentally, when stack sensor 84 detects the passage of N sheets and ADU passage sensor 88 does not count N sheets, jam-clearing (step (11)) is to be conducted because an occurrence of jamming is considered to have occurred. Sheet empty sensor 11 checks whether or not documents exist in RADF 10.

When documents exist in RADF 10, actions mentioned above are to be repeated (step (13) - step (4)).

Now, the specific features of the present example will be explained as follows, referring to FIG. 3.

When the stack of the first document is detected by stack sensor 84 (first ready condition; FIG. 3 (*f*)), and passage sensors (63*a*, 63*b* 63*c* in FIG. 2) detects the passage of N sheets that is the number of copies set (second ready condition; FIG. 3 (*c*)), timing control means 117 gives instructions for sheet refeeding to ADU 80 (FIG. 3 (*g*)).

Figure 3:
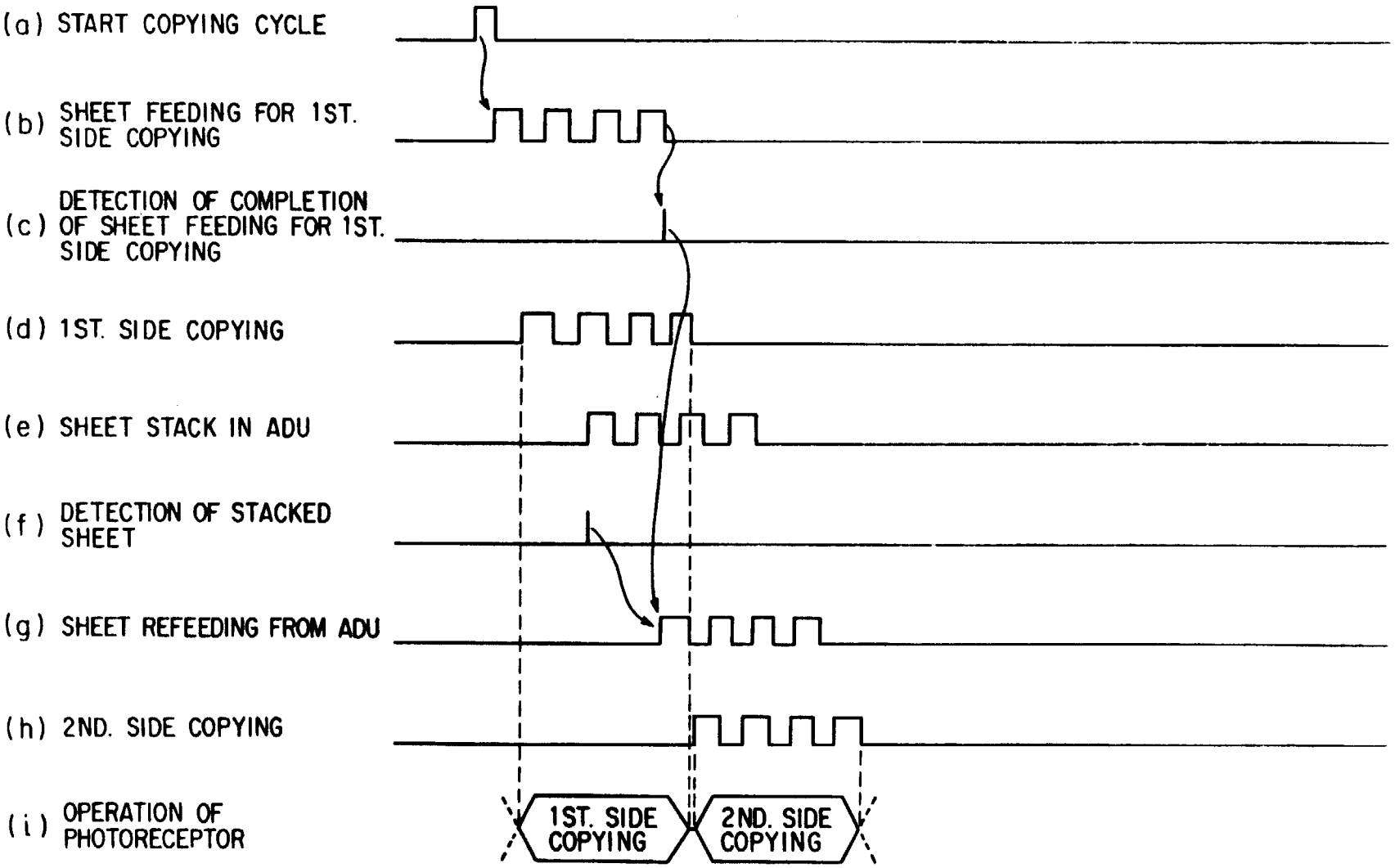
FIG. 3 is a time chart illustrating the state of operations in the apparatus of the example.

Under the constitution mentioned above, the timing of refeeding from ADU 80 is advanced and consequently, no waiting time between the first side copying and the second side copying is created as shown in FIG. 3 (*i*).

Figure 4:
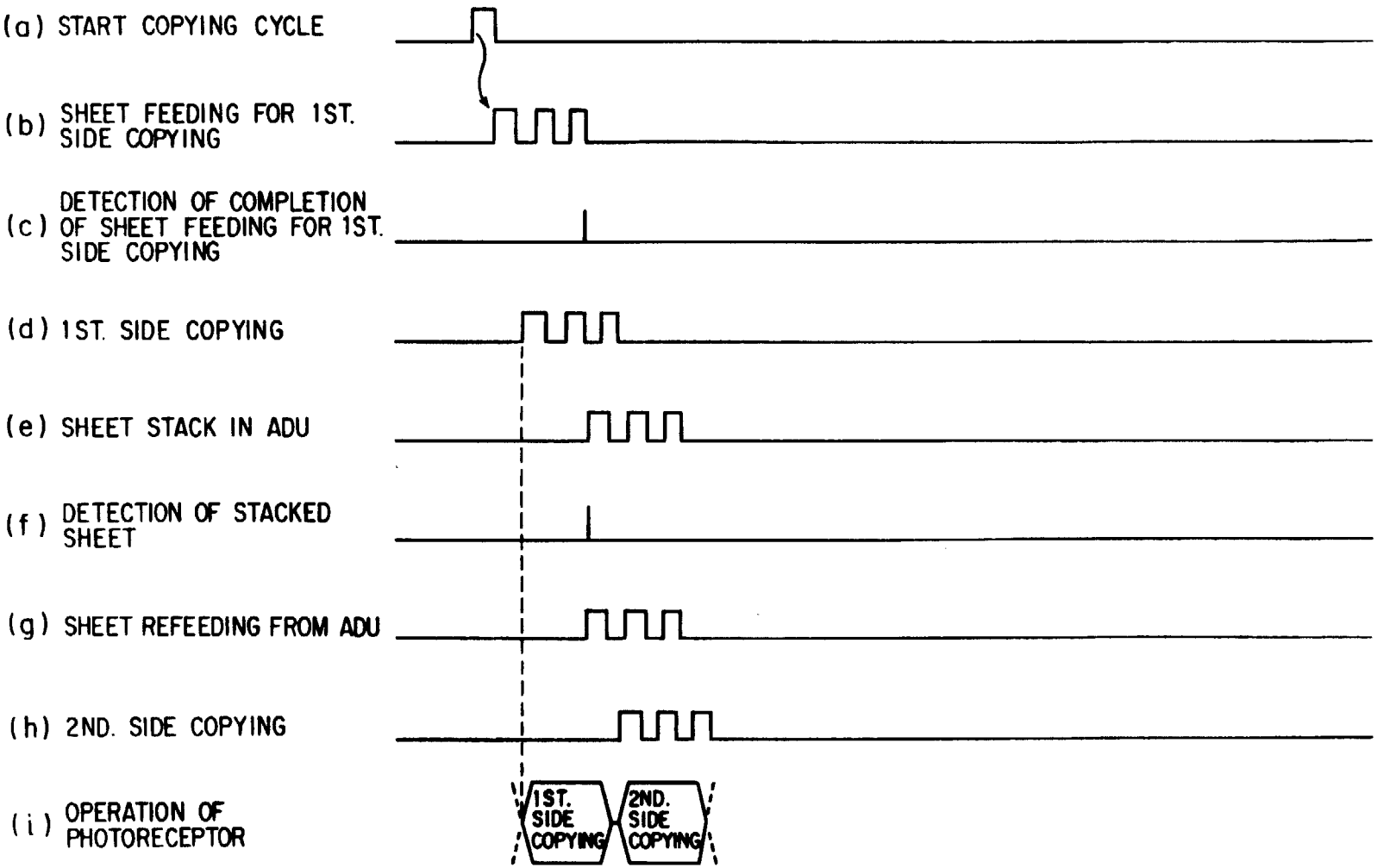
FIG. 4 is a time chart illustrating the state of other operations in the apparatus of the example.
Figure 5:
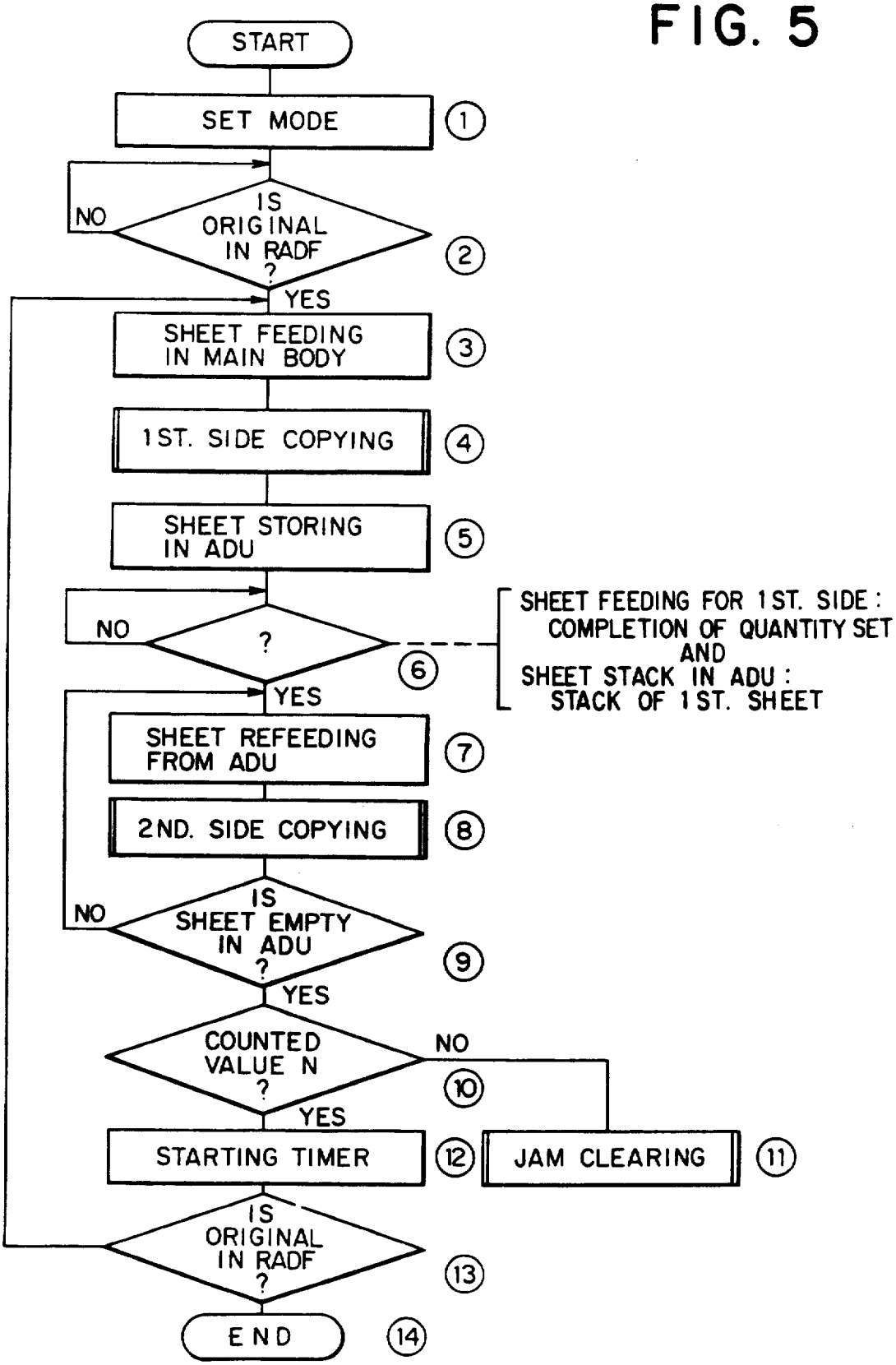
FIG. 5 is a flow chart showing the operations in an automatic duplex copying apparatus of the example shown in FIG. 1.
Figure 6:
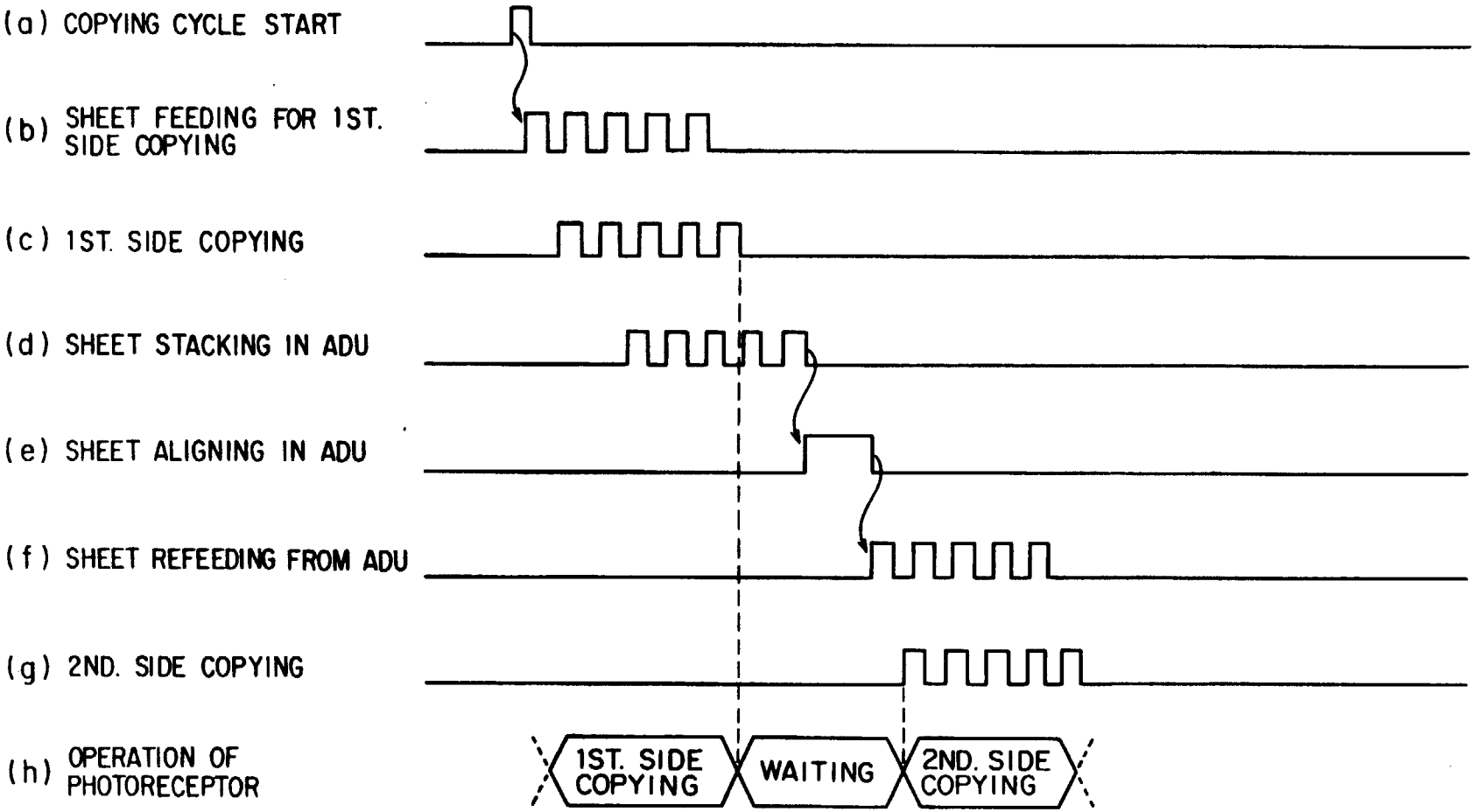
FIG. 6 is a time chart illustrating the copy-productivity of a conventional automatic duplex copying apparatus.
Figure 7:
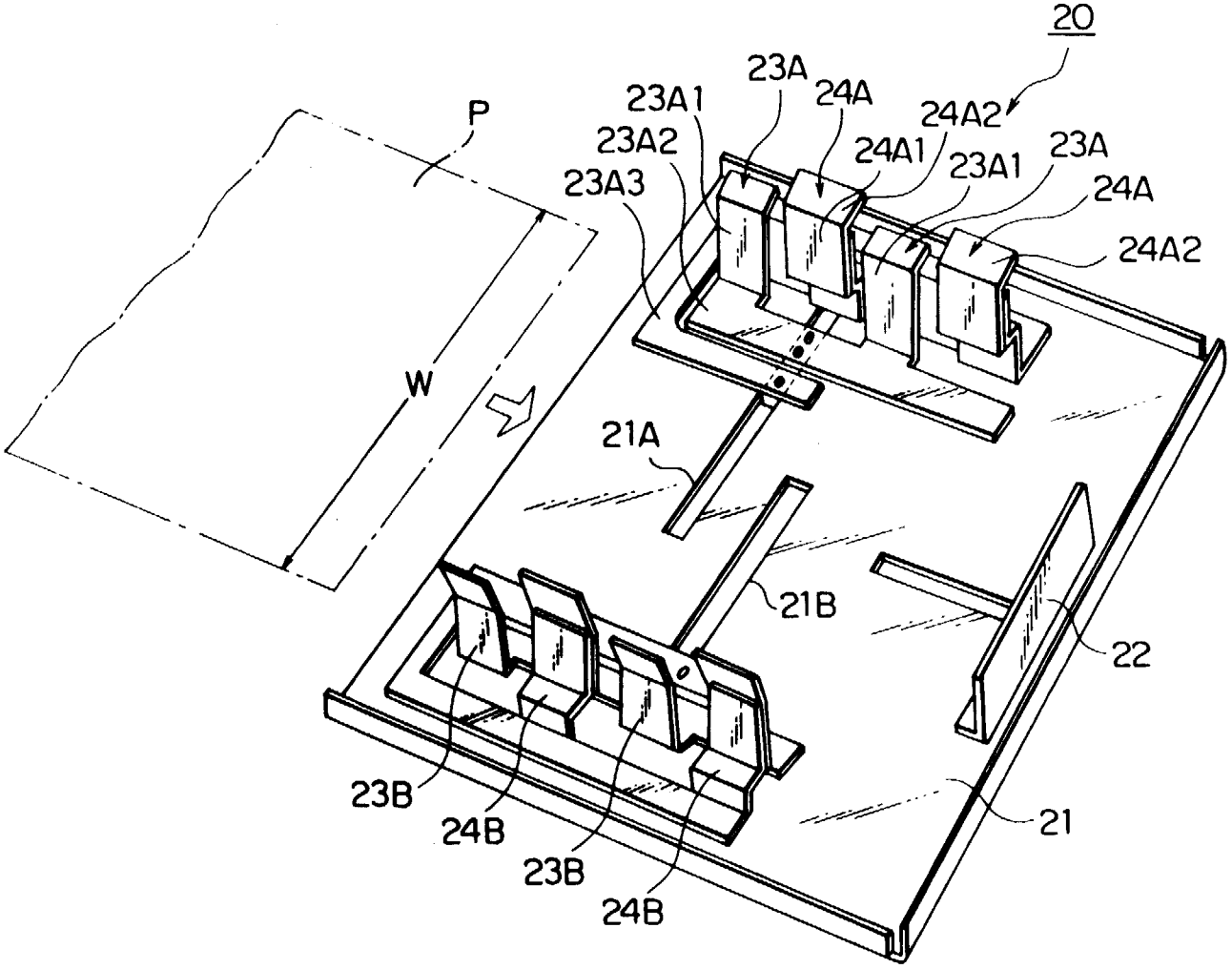
FIG. 7 is a perspective view of the external appearance of an intermediate tray unit of the invention.
Figure 8:
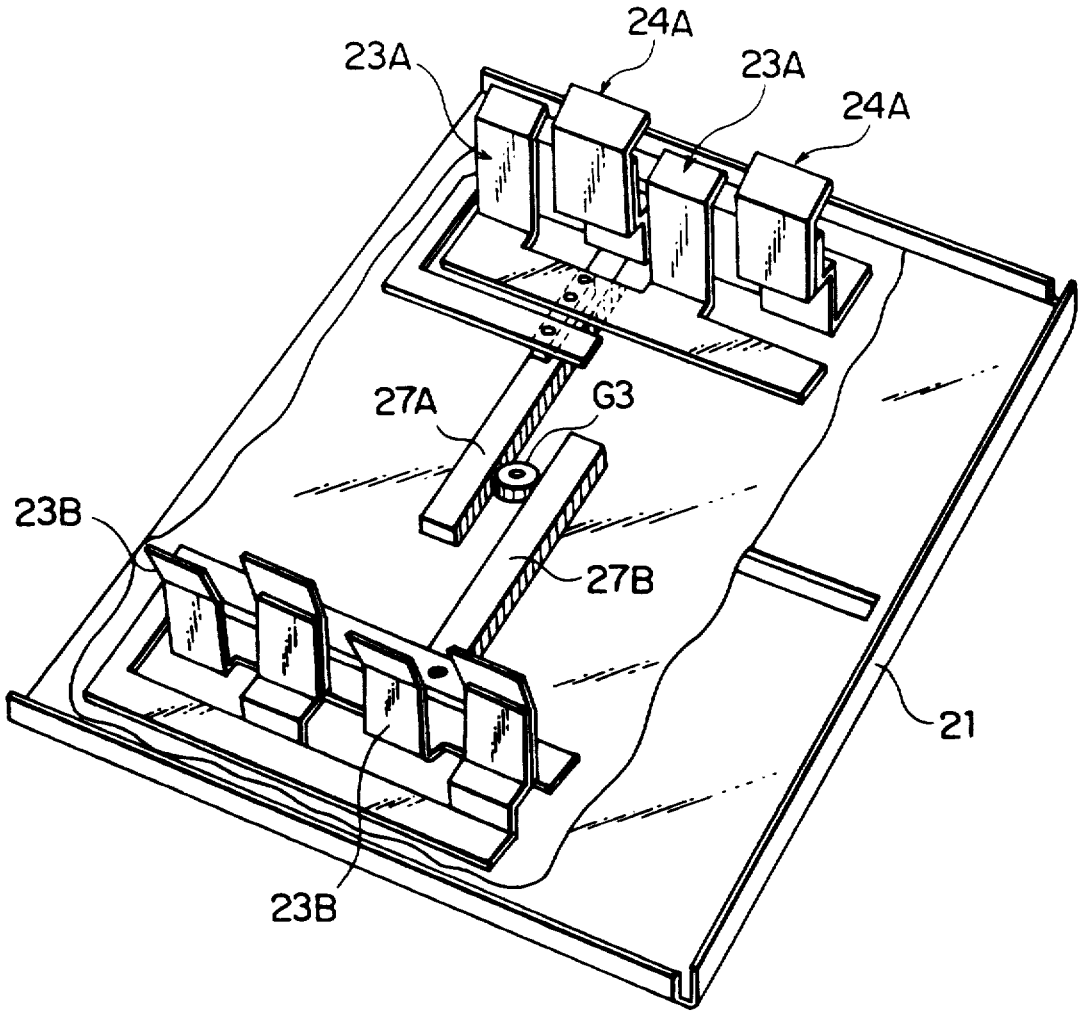
FIG. 8 is a perspective view with a partial sectional view of the aforesaid intermediate tray unit.

Incidentally, in FIG. 3, the number of copies set is large to some extent and the stack detection is ahead of the completion of the first side sheet feeding. When the number of copies set is small, the completion of the first side sheet feeding is ahead of the stack detection as shown in FIG. 4. In any case, it is possible to limit useless waiting time to the minimum because the start of copying on the second side is instructed when both conditions become ready. As a result, it is possible to improve the copy-productivity in duplex copying.

Incidentally, useless waiting time is actually limited to the minimum in the occasion wherein the recording sheet coming from ADU 80 through refeeding arrives at registration roller 62 immediately after the last recording sheet in the number of copies set for the first side copying passes through the registration roller 62 under aforesaid instruction of timing. In that occasion, it is possible to adjust positions of sensors and to adjust timing by means of a timer.

Examples of a sheet feeding device of the invention will be explained in detail as follows, referring to the attached drawings.

Figure 16:
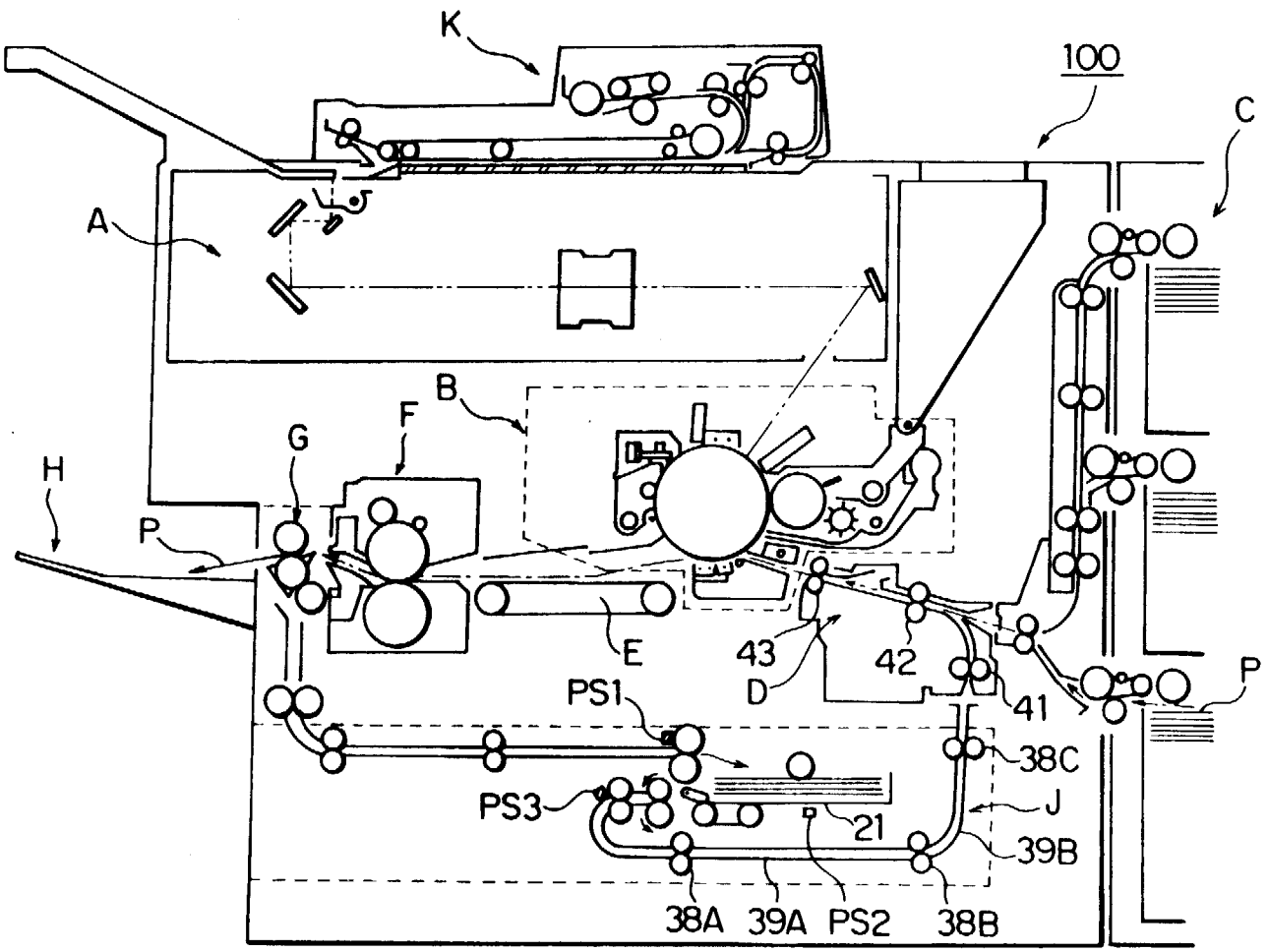
FIG. 16 is a total structural diagram of an image recording apparatus related to the invention.

FIG. 16 represents a total structural diagram of an image recording apparatus (e.g. an electrophotographic copying machine) related to the invention. In the figure, copying machine main body 100 is composed of scanning exposure section A, image forming section B, recording sheet feeding section C, sheet feeding section D, conveyance section E, fixing section F, sheet ejection section G, sheet ejection tray H and automatic duplex unit (ADU) J. In the figure, a dashed line represents a conveyance path for recording sheet P.

Incidentally, reversible automatic document feeder (RADF) K with automatic reversal function is provided on the top of aforesaid copying machine main body 100.

Referring to FIG. 16, the conveyance path for recording sheet P will be explained next.

A document is fed onto a document table glass (platen exposure section) of copying machine main body 100 by an operation of reversible automatic document feeder (RADF) K and stops there, and then an image on the document is subjected to scanning exposure by means of scanning exposure section A and thus an image to be copied is formed by image forming section B. Recording sheet P fed out from recording sheet supply section C synchronizing with aforesaid operation is subjected to transfer of the image to be copied thereon in the transfer section in image forming section B and is fixed in fixing unit F. After that, the recording sheet passes through a stacker introduction section by means of a switching means in sheet ejection section G and is stacked on a sheet tray (stacker) of automatic duplex unit (ADU) J for copying on the reverse side.

Figure 15:
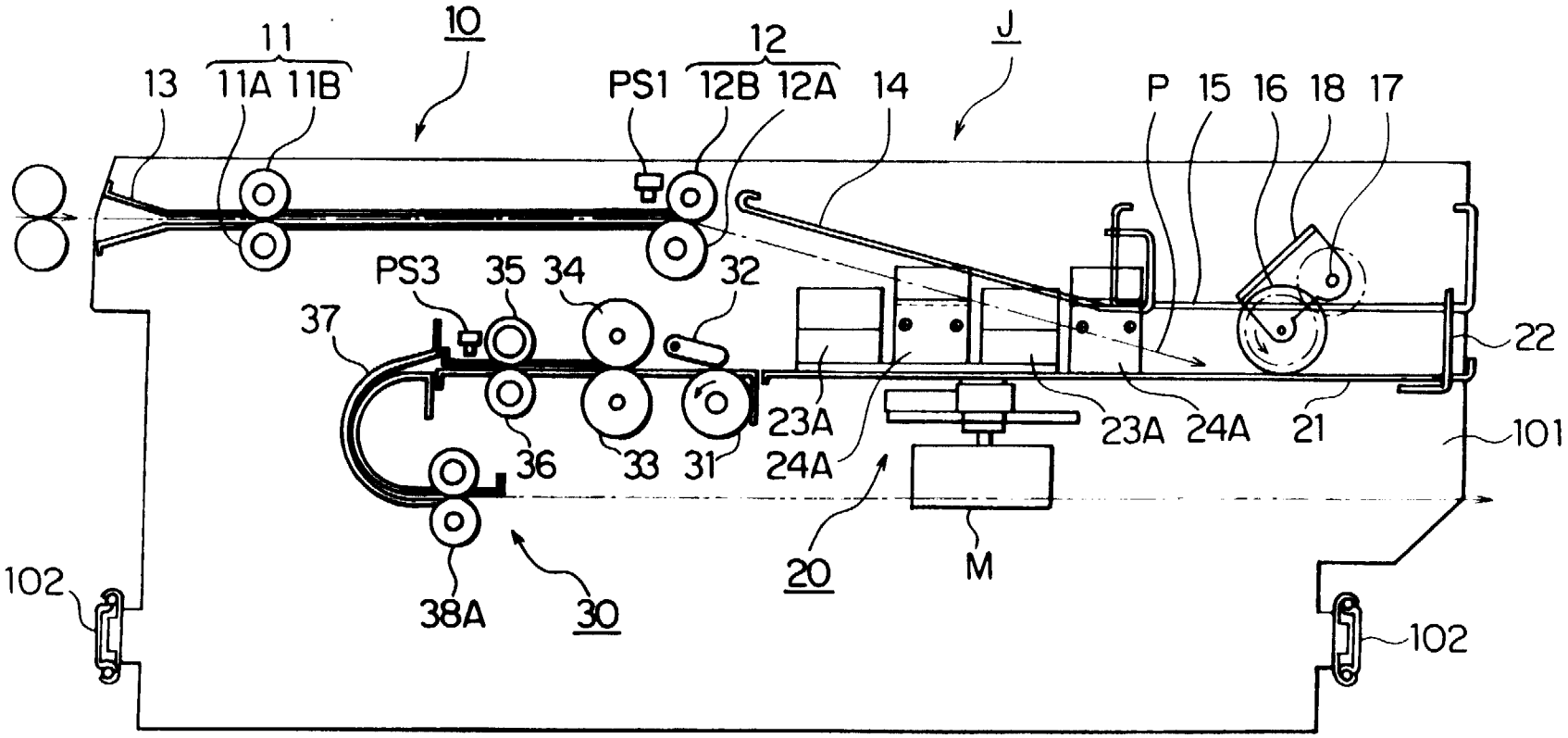
FIG. 15 is a sectional view of an automatic duplex unit.

FIG. 15 is a sectional view of aforesaid automatic duplex unit (ADU) J. The automatic duplex unit J is composed of recording sheet introduction means 10, intermediate tray unit 20 and sheet refeeding means 30.

The aforesaid recording sheet introduction means 10 is composed of conveyance rollers 11 and 12, guide plate 13, recording sheet guiding elastic wires 14 and 15, leading edge aligning roller 16, recording sheet trailing edge detection sensor PS1, and an unillustrated driving mechanism. Conveyance rollers 11 and 12 are composed of lower driving rollers 11B and 12B linked to driving source and upper driven rollers 11A and 12A which are in pressure-contact with aforesaid driving roller and driven thereby for rotation.

Elastic wires 14 and 15 prevent recording sheet P advanced on intermediate tray main body 21 from warping upward and climbing over movable stopper 22, which will be described later.

Leading edge aligning roller 16 is rotated through gear connection to swiveling shaft 17 that is connected to an unillustrated driving source, and is swiveled being supported by swiveling arm 18 that can swivel around aforesaid swiveling shaft 17. The leading edge aligning roller 16 pressure-contacts the recording sheet conveyed onto intermediate tray main body 21 and moves the recording sheet until it hits movable stopper 22.

Intermediate tray unit 20 is composed of tray main body 21, movable stopper 22, first sheet width regulating members 23A and 23B, second sheet width regulating members 24A and 24B, and a driving mechanism.

The aforesaid movable stopper 22 is moved by an unillustrated driving means and stops at a predetermined position corresponding to the size of the conveyed recording sheet P, and thus performs sheet alignment of the recording sheets in their advancing direction.

Figure 12A:
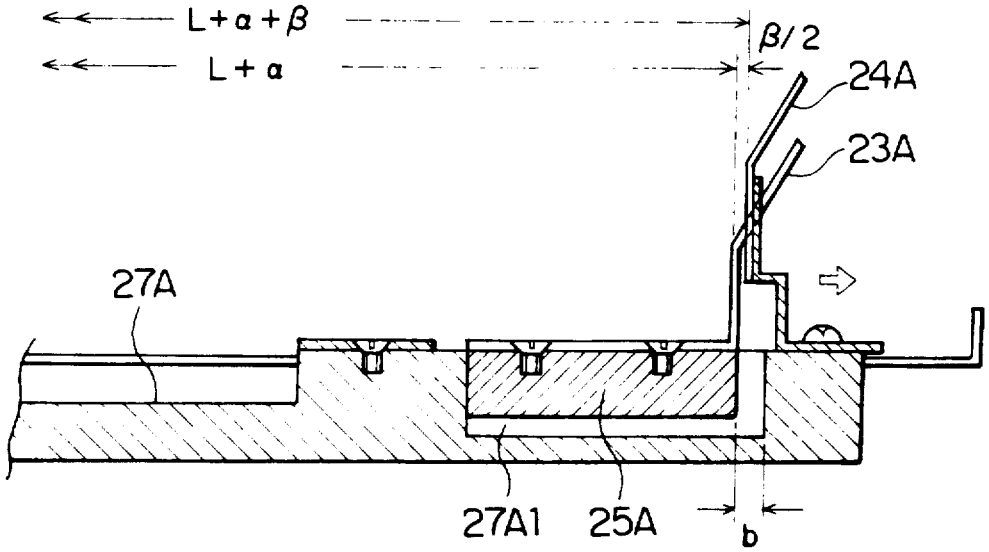
FIGS. 12A and 12B are partial detailed sectional view of the aforesaid unit.
Figure 12B:
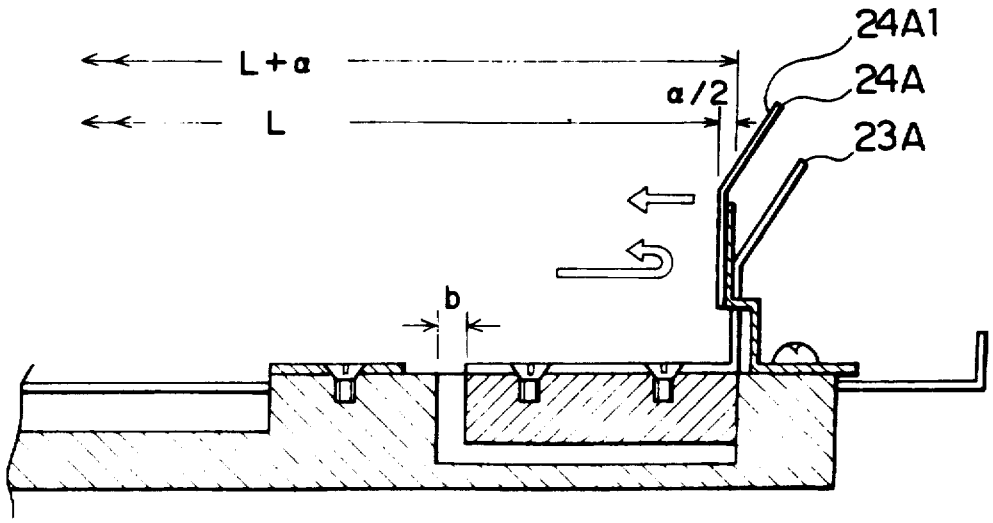
Figure 13:
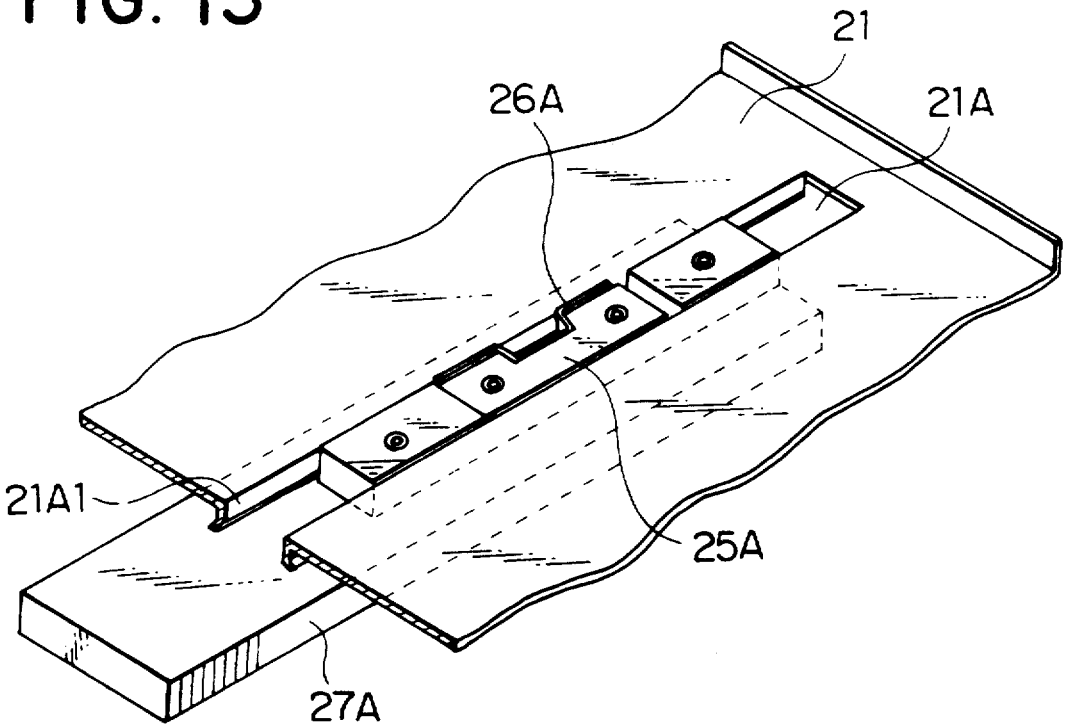
FIG. 13 is a partial perspective view.

In FIG. 7 through FIG. 14, the first sheet width regulating member 23A on one side is composed of a plurality of vertical planes (two locations in the figure) 23A1 and 23A1 and of bottom sliding plate 23A2 that is solidly united with aforesaid vertical planes. The sliding plate 23A2 is fixed with screws on the top surface of slide-block (intermediate moving body) 25A. The slide-block 25A is inserted in recess 27A1 of rack gear 27A and is capable of moving along inner wall 21A1 thereof and is urged by spring 26A in the direction perpendicular to the moving direction of rack 25A. The spring 26A, as shown in FIGS. 12 and 13, is sandwiched between inner wall 21A1 on one side of elongated groove 21A the aforesaid intermediate tray main body 21 of tray unit 20 (see FIG. 15) and recess 25A1 of slide-block 25A, and gives resisting force for sliding (braking force) to slide-block 25A when rack 27A moves.

The rack 27A is driven straight by the rotation of pinion gear G1 attached on DC reversible pulse motor M and rotation of 2-step gears G2 and G3 engaging with the pinion gear G1, and makes straight reciprocation along elongated groove 21A on intermediate tray main body 21.

The first sheet width regulating member 23B on the other side is formed to be symmetric with the aforesaid regulating member 23A on one side and is caused by rack 27B to make straight reciprocation in the same manner as the foregoing along elongated groove 21B symmetrically with regulating member 23B. In this case, 25B is inserted in the recess 27B1 of the aforesaid rack 27B and operates similarly to aforesaid 25A due to the slide block being, urged by spring 26B. The length of movement for each of the aforesaid slide-blocks 25A and 25B is made to be shorter than the length of each of recesses 27A1 and 27B1 of racks 27A and 27B respectively so that a clearance b may be formed.

Figure 14:
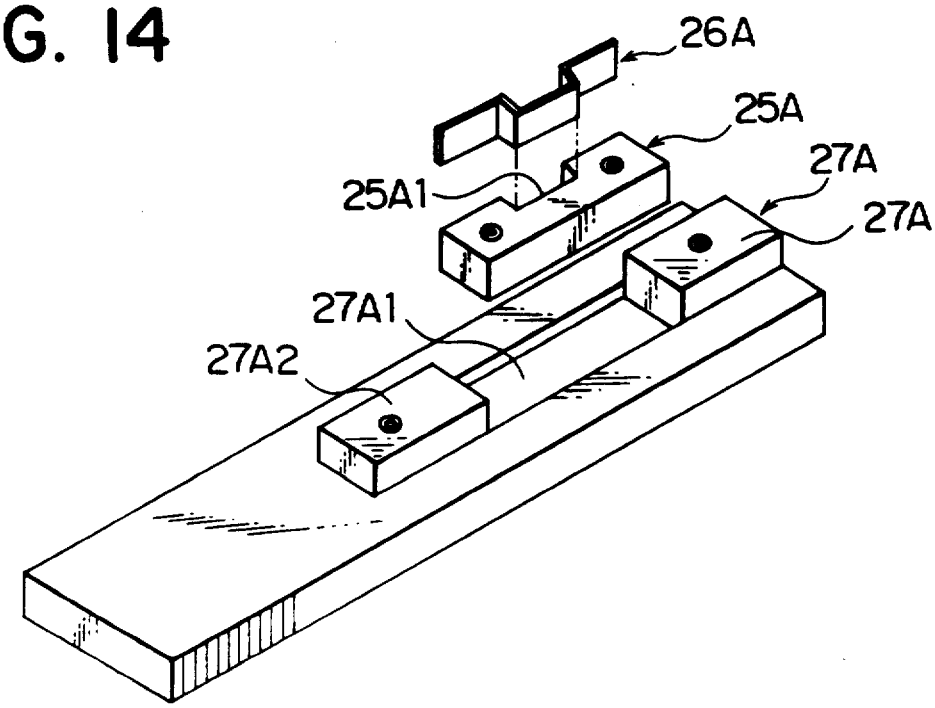
FIG. 14 is an exploded perspective view of the part in FIG. 13.

As shown in FIGS. 13 and 14, both side edges of two protrusions 27A2 on upper portions at both sides of aforesaid recess 27A1 of rack 27A on one side are inserted in the aforesaid elongated groove 21A1 and are movable, and on the top of them, bottom plate 24A3 of the second sheet width regulating member 24A is fixed with screws. The second sheet width regulating member 24A is composed of plural vertical planes (two locations in the figure) 24A1 and 24A1, inclined planes 24A2 and 24A2 and bottom plate 24A3, all formed solidly. The top edge of the each of aforesaid vertical plane 24A1 and inclined plane 24A2 is located to be higher than the vertical plane 23A1 of the aforesaid first sheet width regulating member 23A.

In the same manner as the foregoing, rack 27B on the other side is formed to be symmetrical with aforesaid rack 27A and is united solidly with the second sheet width regulating member 24B.

Figure 9:
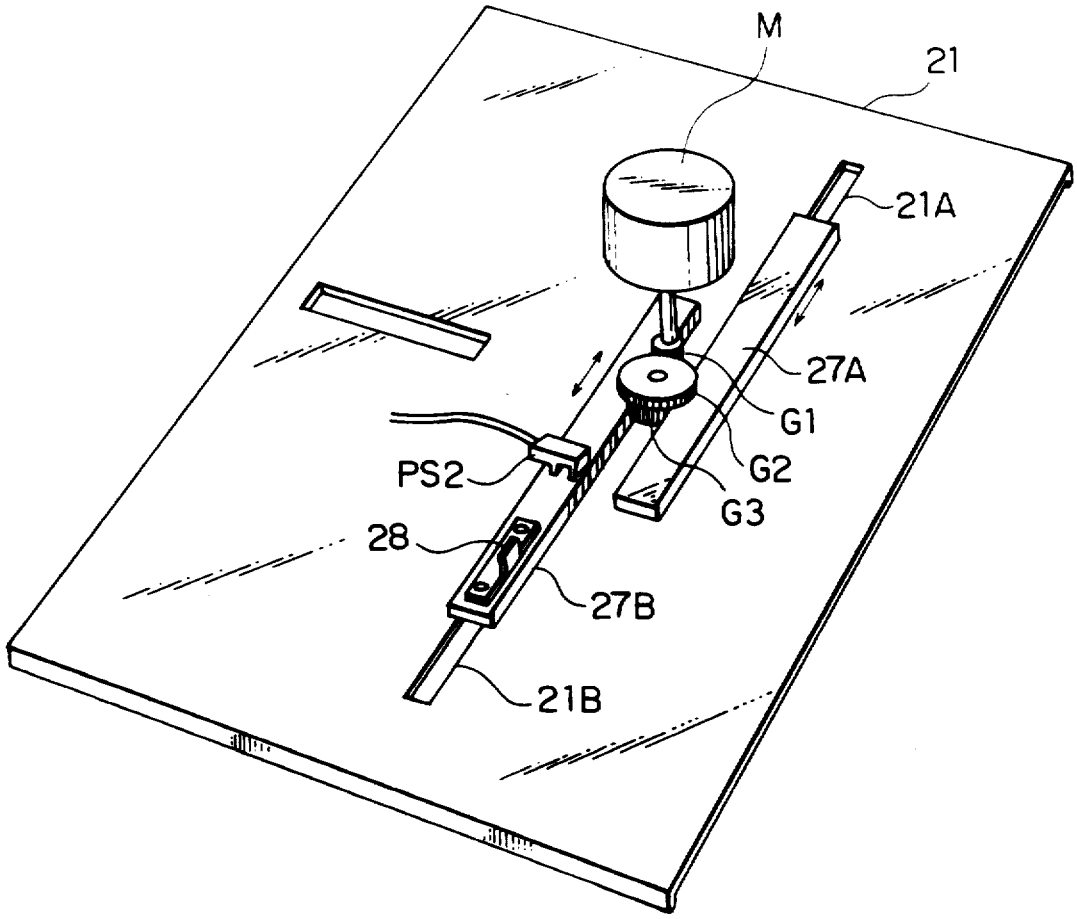
FIG. 9 is a perspective view of the aforesaid unit viewed from its bottom side.
Figure 10:
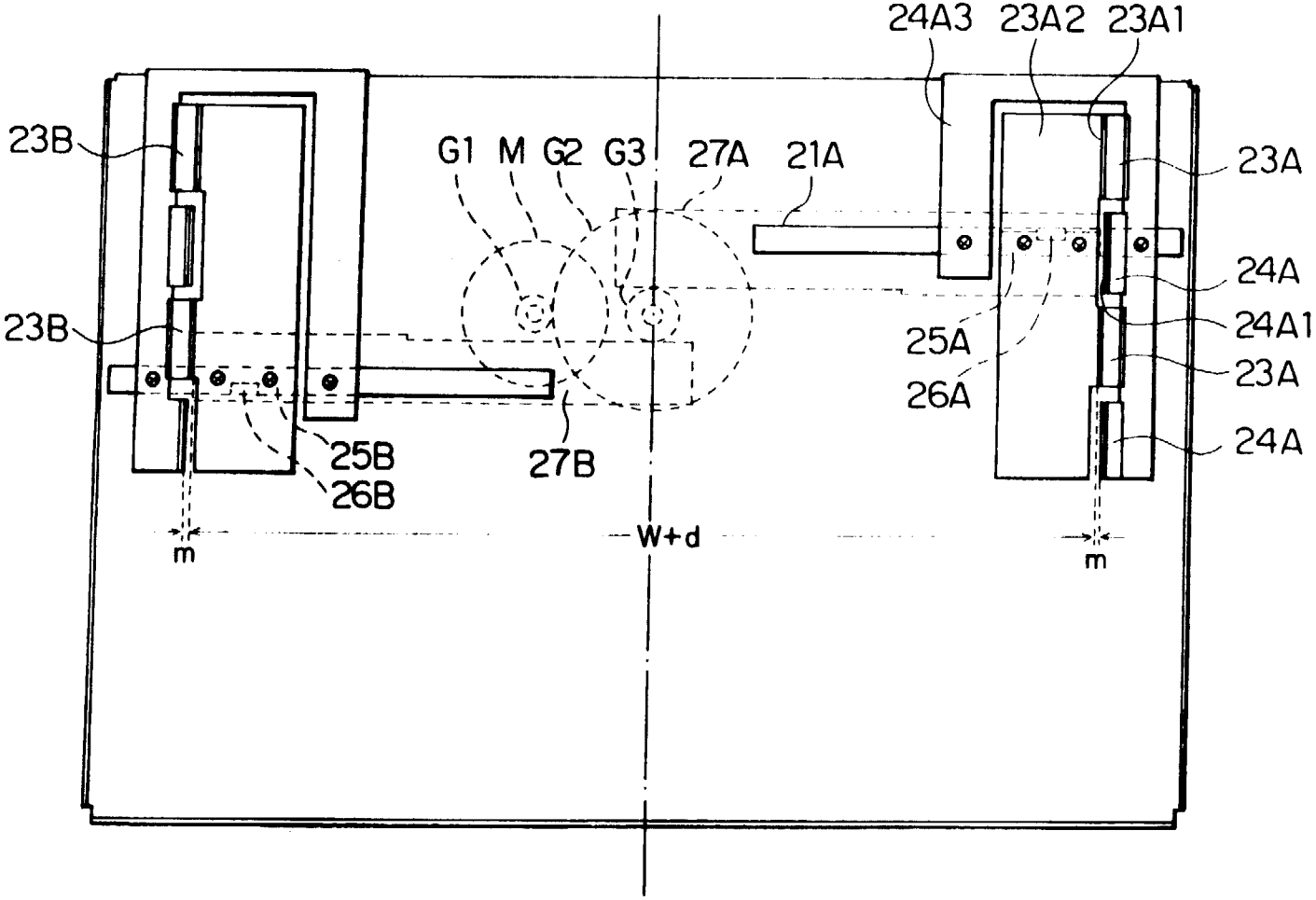
FIG. 10 is a top view of the aforesaid unit.
Figure 11A:
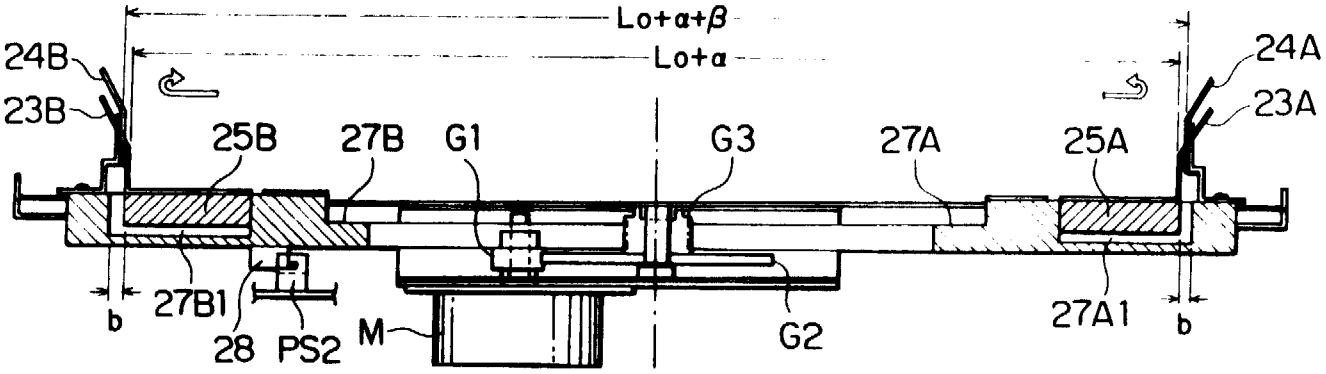
FIGS. 11A and 11B are sectional side view of the aforesaid unit.
Figure 11B:
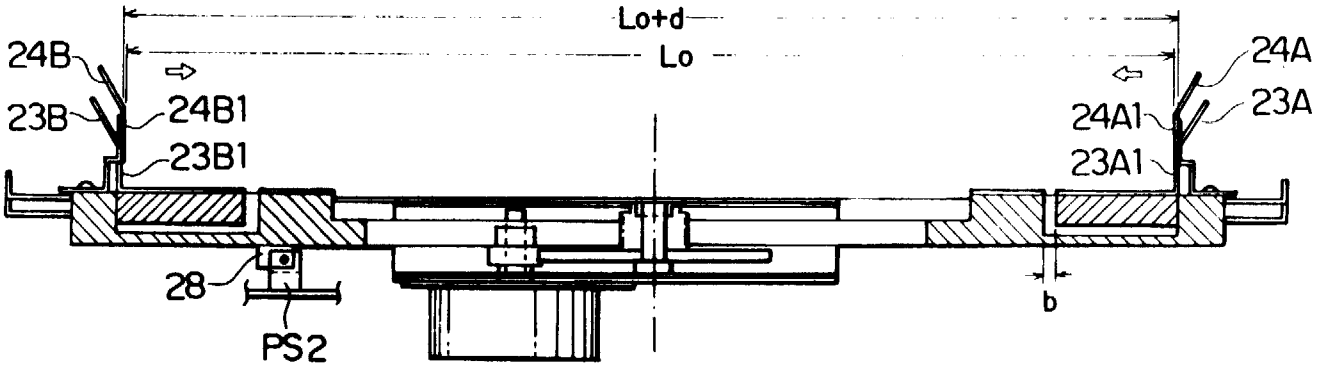

At a part of the lower surface of the aforesaid rack 27B, there is fixed home position detection plate 28 as shown in FIG. 9. On the other hand, on an unillustrated holding plate that is united solidly with the lower surface of intermediate tray main body 21, position sensor PS2 is attached. The position sensor PS2 is, for example, a transmission type photocoupler (a photointerrupter) wherein a light emitting diode and a phototransistor are combined. In the light detection recess of the position sensor PS2, there is provided the aforesaid home position detection plate 28 so that it may pass though the recess without touching it, and the switch is turned on or off when the home position detection plate 28 crosses the recess.

The aforesaid home position detection plate 28 is provided at the position where it constantly turns off the position sensor PS2 in the case of A4 size or smaller sheets than that and turns on in the case of sheets having sizes exceeding the A4 size.

Next, operations of a sheet width aligning means in the automatic duplex unit of the invention will be explained.

(i) First, a home position setting operation will be explained.

When a command for stopping the sheet width regulating member of intermediate tray unit 20 (shown in FIG. 15) at a home position is issued from CPU;

(1) when the position sensor PS2 is in the state of ON (when setting is to A4 size or larger than that), pulse motor M is driven by the aforesaid command and racks 27A and 27B move inward so that the distance between the second sheet width regulating members (hereinafter referred to as the second regulating plates) 24A and 24B may be narrowed, when the position sensor PS2 detects the passage through the position set for the home position, the position sensor PS2 is turned off and thereby the sheet width regulating member is stopped. In this case, slide blocks 25A and 25B united solidly with the first sheet width regulating members (hereinafter referred to as the first regulating plates) 23A and 23B are pressed by outside edges of recesses 27A1 and 27B1 of racks 27A and 27B, both united solidly with the second regulating plates 24A and 24B, and move being united solidly with the aforesaid second regulating plates 24A and 24B and then stop at the position where the distance between vertical planes 23A1 and 23B1 of the first regulating plates 23A and 23B is $L_o$ (corresponding to A4 size) $+\alpha$. In this case, the distance between the vertical planes 24A1 and 24B1 of the second regulating plates 24A and 24B is narrower than the aforesaid $(L_o+\alpha)$ (e.g., about the same as $L_o$). (See FIG. 11 (B).)

When a command for stopping the sheet width regulating member of intermediate tray unit 20 (see FIG. 15) at a home position is issued from CPU;

(2) when the position sensor PS2 is on the state of OFF (when setting is to A4 size or smaller than that), the pulse motor M is driven by the aforesaid command and racks 27A and 27B are moved outward accordingly so that the distance between the second regulating plates 24A and 24B may be broadened. After the position sensor is caused to be ON by the detection of the passage through the position for home position setting, the second regulating plates are broadened (overrunning) by a predetermined amount Z. After that, both regulating plates are moved again by a reverse rotation to be narrower and stop at the home position where the detection plate 28 passes through the position sensor PS2. Since slide blocks 25A and 25B each united solidly with the first regulating plates 23A and 23B are pressed by edges of recesses 27A1 and 27B1 of racks 27A and 27B each united solidly with the second regulating plates 24A and 24B while the regulating plates are being broadened, the distance between the vertical planes 23A1 and 23B1 of the first regulating plates 23A and 23B is narrower than that between the second regulating plates 24A and 24B by the clearance b shown in FIG. 11 (A). As shown in the aforesaid operations, therefore, the position sensor PS2 is turned off at the home position where the second regulating plates 24A and 24B are closed after being broadened excessively for the amount of b or more. Thereby, the distance between the vertical planes of the first regulating plates 23A and 23B is made to be $L_o+\alpha$. In this case, the predetermined amount Z for overrunning during the period when aforesaid second regulating plates 24A and 24B are broadened is set to be equal to or larger than the aforesaid distance b.

It is possible to stop the first regulating plates 23A and 23B accurately at the home position by doing aforesaid operations (1) and (2).

The reasons for the home position to be the width of A4 size in the above case are that A4 size sheets are used most frequently and that A4 size can reduce the moving time for width regulating plates to move to each size of sheet because the A4 size is between the maximum size (A3 size) and the minimum size (B5 size). According to circumstances, however, the home position may be caused either to be the maximum size or to be the minimum size, or even to be another size.

(ii) Sheet Size Setting Operation (1) After a duplex copying mode is set, a size of a sheet (image transfer sheet) is selected and a copy button is turned on, the aforesaid first regulating plates 23A and 23B as well as the second regulating plates 24A and 24B move respectively to predetermined positions according to the selected sheet size.

To the predetermined position mentioned above, regulating plates are moved from the aforesaid home position through the gear train by means of pulse motor M driven for a period corresponding to the pulse number, and even in this case, when the sheet width regulating plates are narrowed, they are moved only in one direction for a period corresponding to the number of pulses, and stopped as stated above. When the sheet width regulating plates are broadened, the regulating plates are excessively broadened by means of overrunning by the constant amount Z as stated in (i) described above and then narrowed through reverse running and stopped at the position of the set sheet size. With regard to the sheet width regulating plates, in this case, the distance b between the recesses 27A1 and 27B1 of racks 27A and 27B and slide blocks 25A and 25B is determined so that the distance between the second regulating plates 24A and 24B may be narrower than $(L+\alpha)$ which is the distance between the first regulating plates 23A and 23B as shown in FIG. 12 (B). The aforesaid difference of distance $\alpha$ is generally set to 0–6 mm. In case of an A4 size sheet, for example, $(L+\alpha)$ is set to 299 mm ($\alpha$ is 2 mm) for the sheet width of 297 mm.

(2) After completion of the aforesaid operations, pulse motor M is driven so that the second regulating plates may be broadened outward to generate the distance between them of $(L+\alpha=\beta)$.

In this case, the clearance b formed at recesses 27A1 and 27B1 of the aforesaid racks 27A and 27B is determined so that the second regulating plates 24A and 24B may not touch the first regulating plates 23A and 23B even when the second regulating plates are moved to generate the distance between them of $(L+\alpha+\beta)$. In this case, the second regulating plates 24A and 24B are to be movable, with the first regulating plates 23A and 23B suspended maintaining the distance $(L+\alpha)$, from the distance L shown in the aforesaid FIG. 12 (B) to the distance $(L+\alpha+\beta)$ shown in FIG. 12 (A). The distance difference $\beta$ mentioned is usually set to 2-10 mm. In the case of a sheet of the aforesaid A4 size, for example, $(L+\alpha+\beta)$ is set to 305 mm for the width of the sheet of 297 mm ($\alpha=2$ mm, $\beta=6$ mm). Standby operation is finished with the distance $(L+\alpha+\beta)$ between the second regulating plates 24A and 24B.

(iii) Sheet Alignment Operation

When a sheet with a width of W is ejected by the aforesaid conveyance roller 12 shown in FIG. 15 onto intermediate tray main body 21 which is on a standby state after completion of the sheet size setting operation described in above-mentioned item (ii), the passage of a trailing edge of the sheet is detected by detection sensor PS1. At a point that is after a certain period of time from the reference point of passage of trailing edge of the sheet and before the next sheet is ejected, the second regulating plates 24A and 24B are narrowed, for width aligning of sheets, to the distance L shown in FIG. 12 (B) at least once, and then are broadened to the distance $(L+\alpha+\beta)$ to be on a standby state. Due to the movement of the aforesaid second regulating plates 24A and 24B, a sheet ejected from above-mentioned conveyance roller 12 is guided by inclined surfaces 24A2 and 24B2 of the second regulating plates 24A and 24B positioned above the first regulating plates 23A and 23B, and the sheet further touches vertical planes 24A1 and 24B1 and thereby is aligned in terms of its width. Then, the sheet drops downward due to the movement of the second regulating plates 24A and 24B such as extension of a distance between them and their retreating movement, and enters the distance $(L+\alpha)$ between vertical planes 23A1 and 23B1 respectively of the first regulating plates 23A and 23B to be positioned properly.

The above mentioned movements for narrowing and broadening the distance between the second regulating plates 24A and 24B are conducted for each sheet ejected from conveyance roller 12 and fed into intermediate tray unit 20 for alignment of the sheet, thus the movements are repeated.

A sheet subjected to at least one cycle of the aforesaid sheet alignment is regulated in terms of its width between the first regulating plates 23A and 23B, and is stacked.

(iv) Feeding-Out Operation

After completion of sheet alignment operation described in aforesaid item (iii), READY signals for sheet refeeding to be conducted by automatic duplex unit (ADU) J are outputted to copying machine main body 100.

Due to the aforesaid generation of READY signals, sheet refeeding means 30 shown in FIG. 15 becomes ready to start.

The sheet refeeding means 30 is provided in the vicinity of the left end of intermediate tray unit 20 and is composed of a feeding portion, a friction-separation sheet feeding portion, the second sheet feeding portion and a reversing and conveying means. It feeds, on a switchback manner, the recording sheet P on intermediate tray unit 20 (FIG. 15) in the direction opposite to that in which the recording sheet has been fed onto the intermediate tray unit, beginning with the lowermost sheet.

The feeding portion is composed of pick-up roller 31 rotatable in one direction and of pressing lever 32 that is rotatable and presses with a predetermined pressure the tip (of a left edge) of the recording sheet P positioned on the pick-up roller 31.

The friction-separation sheet feeding portion is composed of feed roller 33 that is driven at its fixed position and reverse roller 34 which pressure-contacts the feed roller 33 and has a one-way clutch or a torque limiter built-in.

After one side copying is completed, pressing lever 32 swings and falls to press recording sheet P stacked on pick-up roller 31. Then, the pick-up roller 31 is driven for rotation and it feeds out the recording sheet P with sandwiching pressure generated by the pick-up roller and the pressing lever 32 toward the arrowed direction, thus, the leading edge portion of the recording sheet is fed to the position of a nip between feed roller 33 and reverse roller 34. At this nip position, only one recording sheet at the bottom is fed out in the arrowed direction owing to the multi-feed preventing action made by both rotating feed roller 33 and reverse roller 34 that is driven through a torque limiter in the direction opposite to the advancing direction of recording sheet P and applies pressure to the sheet.

In this case, a recording sheet fed out from the bottom of the stack of recording sheets is constantly regulated in terms of its width by the distance $(L+\alpha)$ between the first regulating plates 23A and 23B, and no problem occurs even when the second regulating plates 24A and 24B positioned above the first regulating plates move in the direction of a sheet width for aforesaid sheet alignment operation (iii) during the aforesaid operation of feeding recording sheets beginning from the lowermost sheet and conduct sheet alignment operation after conveying the recording sheet onto the top of the stack of recording sheets. Namely, sheet alignment for recording sheets fed and positioned at the upper portion of the stack of recording sheets, and sheet feeding beginning from the lowermost sheet of the stack of recording sheets can be conducted simultaneously.

The second sheet feeding means is composed of driving roller 35, driven roller 36 that is in pressure-contact with the driving roller 35 and is driven thereby for rotation and recording sheet leading edge detection sensor PS 3, and conveys the recording sheet fed out from the friction-separation sheet feeding portion to a pair of intermediate conveyance rollers 38A positioned at a lower level through guide plate 37.

There is provided an automatic duplex means consisting of plural pairs of intermediate conveyance rollers 38A, 38B and 38C capable of rotating positively, conveyance lower guide plate 39A and curved guide plate 39B, downstream above-mentioned intermediate tray unit 20 in the sheet conveyance direction. (See FIG. 16.)

The recording sheet fed out downward from the aforesaid second sheet feeding means is sandwiched by conveyance roller 38A to be conveyed horizontally, enters the gap between guide plates 39A to be guided thereby, is sandwiched by intermediate conveyance rollers 38A, passes through curved guide plate 39B, and then is ejected out from automatic duplex unit (ADU) J by means of intermediate conveyance roller 38C located in the vicinity of the upper outlet.

The recording sheet P ejected out from automatic duplex unit J passes through intermediate conveyance rollers 41 and 42 and further registration rollers 43 and then is subjected to image forming on its reverse side. After that, the recording sheet P is ejected and placed on sheet ejection tray H through a sheet ejection switching means in sheet ejection section G wherein sheet transfer direction switching is arranged. Recording sheets stacked on an upper portion of the stack on intermediate tray main body 21 are fed out in succession from the bottom of the stack and pass through the aforesaid conveyance path to be ejected and placed on the sheet ejection tray H.

The above-mentioned automatic duplex unit J for recording sheets for duplex copying is of a unit construction and on both sides of the unit frame 101, there are provided slide rail members 102 and 102 through which the unit frame can be drawn out of the copying machine main body 100.

As stated above in detail, an automatic duplex copying apparatus of the invention wherein the recording sheet copied on its one side is reversed by an automatic duplex unit and the recording sheet fed out from the automatic duplex unit is copied on its second side is provided with;

a feeding state detection means which detects that recording sheets in the number of copies set have been conveyed from the sheet feeding section in a main body, a refeeding state detection means which detects that refeeding of at least one of stacked recording sheets in the automatic duplex unit is possible, and a timing control means which receives detection output from both a feeding state detection means and a refeeding state detection means and gives instructions for the start of refeeding to the automatic duplex unit.

Due to the foregoing, the detection output by means of the feeding state detection means is generated when it is detected that the recording sheets in the number of copies set have been conveyed from the sheet feeding section in a main body, and the detection output by means of the refeeding state detection means is generated when refeeding of at least one of the recording sheets stacked on the automatic duplex unit is possible. The timing control means, after receiving both detection output, gives instructions for the start of refeeding to the automatic duplex unit.

In this case, since the detection output is generated before all of the recording sheets in the number of copies set have been stacked on the automatic duplex unit, generation of standby time between copying on the first side of the recording sheet and copying on the second side thereof can be limited to the minimum.

Therefore, it is possible to realize an automatic duplex copying apparatus wherein a period of time from completion of copying on the first side of a recording sheet to the start of copying on the second side thereof is shortened, and thereby copy-productivity can be improved.

In a stacker section wherein recording sheets stored temporarily on an intermediate tray unit capable of holding a stack of recording sheets are subjected to refeeding in a sheet feeding device of the invention, as stated above, operation of feeding out recording sheets beginning with the lowest recording sheet is conducted simultaneously with the sheet stacking operation wherein recording sheets are ejected successively from a processing section onto the intermediate tray to be stacked thereon while being aligned in terms of width of the recording sheet. Therefore, it is possible to improve copy-productivity because refeeding of recording sheets can be started without waiting for completion of a series of stacking for the recording sheets.

Further, both operations mentioned above can be controlled simply and sheet refeeding which is sure and accurate can also be applied to high speed duplex copying and document circulative conveyance for stable refeeding.

In a stacker section wherein recording sheets stored temporarily on a tray unit capable of holding a stack of recording sheets are subjected to refeeding in a sheet width aligning unit of a sheet feeding device of the invention, the recording sheets fed onto the tray and stacked thereon are easily guided by the second sheet width regulating members positioned upward to have a distance slightly broader than the width of the recording sheet, then, fall after being aligned in terms of width by the same regulating members whose distance is reduced, and then are aligned surely, when they are stacked stationary on the tray, by the first sheet width regulating members positioned downward to have a distance approximately the same as the width of the recording sheet. The recording sheets are kept in the state mentioned above right before the start of refeeding. Therefore, it is possible to feed recording sheets beginning with the lowest sheet in a stack while the recording sheets fed onto the tray and positioned at an upper part of a stack are being aligned in terms of width. Thus, waiting time is eliminated and copy-productivity can be enhanced.

Further, it is possible to form images at precise positions on both sides of a recording sheet because positioning of recording sheets on a tray is accurate.

Furthermore, troubles such as conveyance trouble of a recording sheet (jamming), skewing, dog-eared portions at the leading edge, or failure to be fed are not caused, resulting in certain and accurate refeeding of sheets and further in stable refeeding in high speed duplex copying.

What is claimed is:

1. An automatic duplex recording apparatus comprising:

(a) processing means for forming a toner image on a recording sheet;

(b) feed means for feeding the recording sheet to said processing means for forming the toner image on a first side of said recording sheet;

(c) first detection means for detecting the completion of feeding of the recording sheet from said feed means;

(d) duplex means including stacking means for receiving and reversing the recording sheet on which a toner image has been formed on a first side thereof, said duplex means refeeding the recording sheet to the processing means for forming a toner image on a second side of the recording sheet;

(e) second detection means for detecting that at least one recording sheet is stacked on the stacking means included in said duplex means; and (f) control means for generating a start timing signal for starting refeeding of the recording sheet stacked on said stacking means when the first detection means detects that the feeding means has completed feeding a preset quantity of recording sheets and the second detection means detects that the recording sheet is stacked on said stacking means, said duplex means starting refeeding in response to the thus generated start timing signal.

2. The apparatus according to claim 1, wherein the duplex means begins refeeding a previously stacked recording sheet while the toner image is being formed on the firs side of another recording sheet.

3. The apparatus according to claim 1, further comprising an automatic document feeder being capable of reversing a document therein.

4. The apparatus according to claim 1, wherein two-sided copying is conducted such that a preset quantity of copying corresponding to a second side of a document are made on the second side of each recording sheet after the preset quantity of copying corresponding to a first side of a document are made on the second side of each recording sheet after the preset quantity of copying corresponding to a first side of a document are made on the first side of said each recording sheet.

* * * * *